US006409549B1

(12) United States Patent
Yeh

(10) Patent No.: US 6,409,549 B1
(45) Date of Patent: Jun. 25, 2002

(54) ELECTRICAL CONNECTOR

(75) Inventor: Joel J. Yeh, San Gabrie, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/001,082

(22) Filed: Oct. 31, 2001

(51) Int. Cl.[7] ..... H01R 24/00

(52) U.S. Cl. ..... 439/676; 439/218; 439/217; 439/166

(58) Field of Search ..... 439/676, 946, 439/131, 166, 217, 218, 224, 956, 173, 174

(56) References Cited

U.S. PATENT DOCUMENTS 5,244,402 A * 9/1993 Pasterchick, Jr. et al. ... 439/217
5,501,608 A * 3/1996 Scheer et al. ..... 439/218
6,141,212 A * 10/2000 Fletcher et al. ..... 439/218
6,142,834 A * 11/2000 Liao ..... 439/131

* cited by examiner

*Primary Examiner*—Tho D. Ta
(74) *Attorney, Agent, or Firm*—Wei Te Chung

(57) ABSTRACT

An electrical connector (1) includes a slide body (2), a terminal module (3) assembled on the slide body. The terminal module comprises a main base (30), a bottom base (31) welded to the main base, a top cover (32) assembled on the main base, eight cam-shaped terminals (33). The main base and the bottom base respectively comprise four alternating upper contacts (302) and lower contacts (321). The top cover comprises a plurality of passageways (313) at a front end thereof. The terminals are pivotably received in the passageways for contacting with the upper and lower contacts.

10 Claims, 5 Drawing Sheets

ELECTRICAL CONNECTOR

BACKGROUND OF THE INVENTION

1. Field of the Invention

The present invention relates to an electrical connector, and particularly to an electrical connector that may contact with either an RJ-11 plug connector or an RJ-45 plug connector.

2. Description of Related Art

Input/output card, such as a memory card or a modem card, has been widely used with the notebook computer. Generally, an additional RJ-11 receptacle connector is moveably assembled to the input/output card to facilitate connection with an RJ-11 plug connector thereinto. However, there is possibility that the input/output card needs to connect with a different RJ plug connector, such as an RJ-45 plug connector or an RJ-11 plug connector, to transmit different signals. Because the RJ-45 plug connector has a similar but larger configuration than the RJ-11 plug connector, conventionally, such needs two different RJ receptacle connectors assembled on the notebook to transmit different signals. In consideration of the miniaturization of the notebook, an electrical connector that may contact with either an RJ-11 plug connector or an RJ-45 plug connector should be designed. Some attempts provides a housing with terminals therein to cooperate with rotatable cam terminals for connecting to the plug connector. Anyhow, it is desired to have a reliable structure retention among these parts.

Hence, an improved electrical connector that can contact with either an RJ-11 plug connector or an RJ-45 plug connector is required to overcome the disadvantages of the conventional electrical connector.

SUMMARY OF THE INVENTION

Accordingly, the object of the present invention is to provide an electrical connector that can contact with either an RJ-11 connector or an RJ-45 connector without damaging contacts of the electrical connector.

In order to achieve the object set forth, an electrical connector comprises a slide body, and a terminal module assembled in the slide body. The slide body comprises a planar bottom plate and a pair of sidewalls formed at each side of the bottom plate. The sidewalls together define a receiving space for receiving a mating flexible printed circuit (FPC) and three recesses communicating with the receiving space. The terminal module comprises a main base, a top cover, a bottom base welded to the main base, eight cam-shaped terminals pivotably assembled in the top cover and a pivot for retaining the terminals in the top cover. The main base comprises a pair of arms extending forwardly, four upper contacts assembled thereon. The arms together define an opening for receiving the top cover, and comprise three projections extending outwardly for being received in the recess of the slide body and a pair of big and small recesses for receiving two ends of the pivot. The bottom base comprises four lower contacts assembled thereon. The top cover comprises a plurality of ribs with a plurality of passageways therebetween at a front end thereof. Each of the ribs and the terminals defines a coaxial hole for receiving the pivot thereby pivotably retaining the terminals in the passageways. When an RJ-45 plug connector mates with the electrical connector, the eight cam-shaped terminals are all received in corresponding passageways defined by the RJ-45 plug connector for contacting corresponding terminals of the RJ-45 plug connector with the upper and lower contacts. While an RJ-11 plug connector mates with the electrical connector, a few terminals of the eight terminals are received in corresponding passageways defined by the RJ-11 plug connector for contacting corresponding terminals of the RJ-11 plug connector with the upper and lower contacts, and the rest terminals are pressed by the RJ-11 plug connector to rotate and being protected.

Other objects, advantages and novel features of the invention will become more apparent from the following detailed description when taken in conjunction with the accompanying drawings.

DETAILED DESCRIPTION OF THE INVENTION

Figure 1:
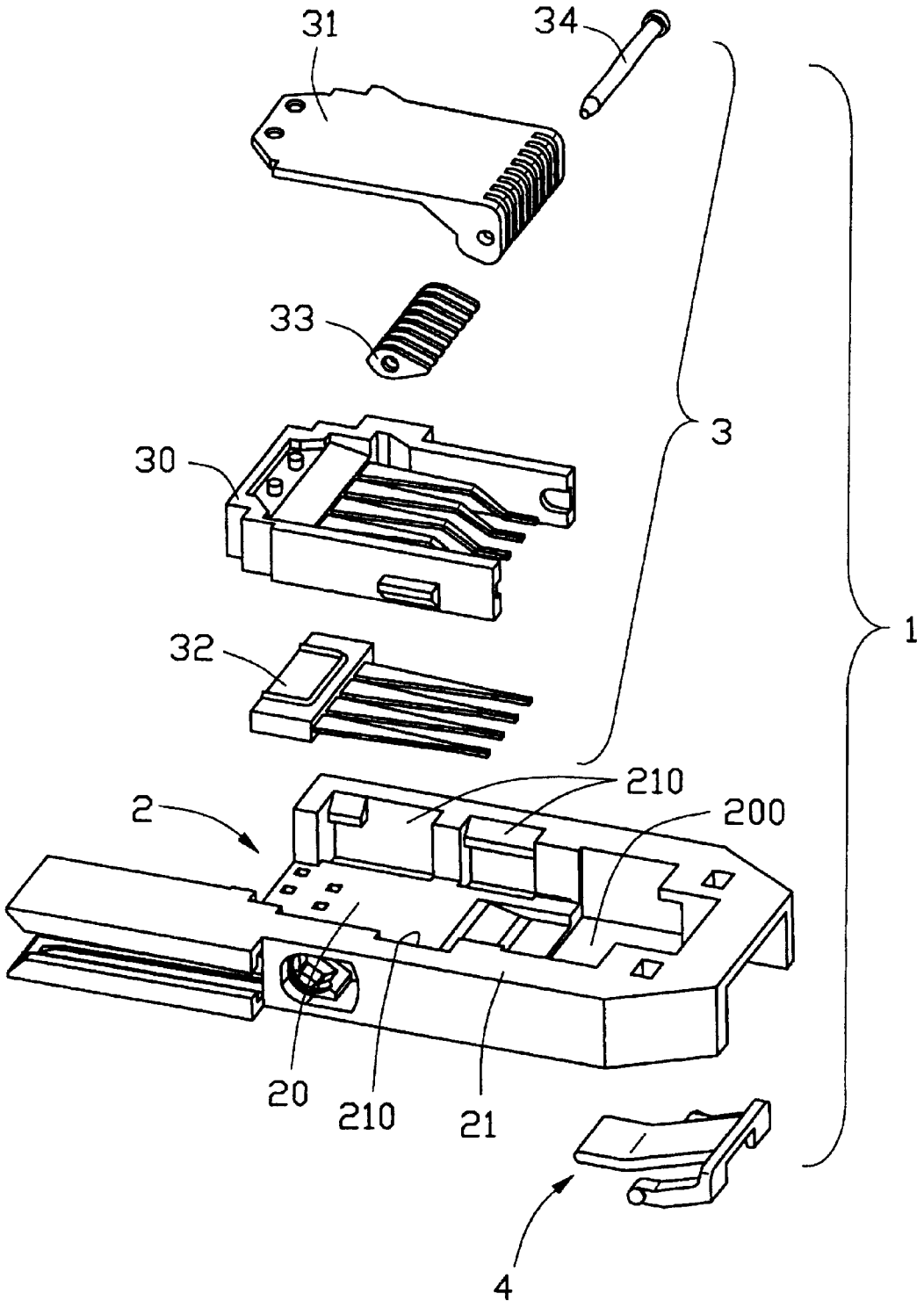
FIG. 1 is a perspective, exploded view of an electrical connector of the present invention.

Reference will now be made to the drawing figures to describe the present invention in detail.

Figure 5:
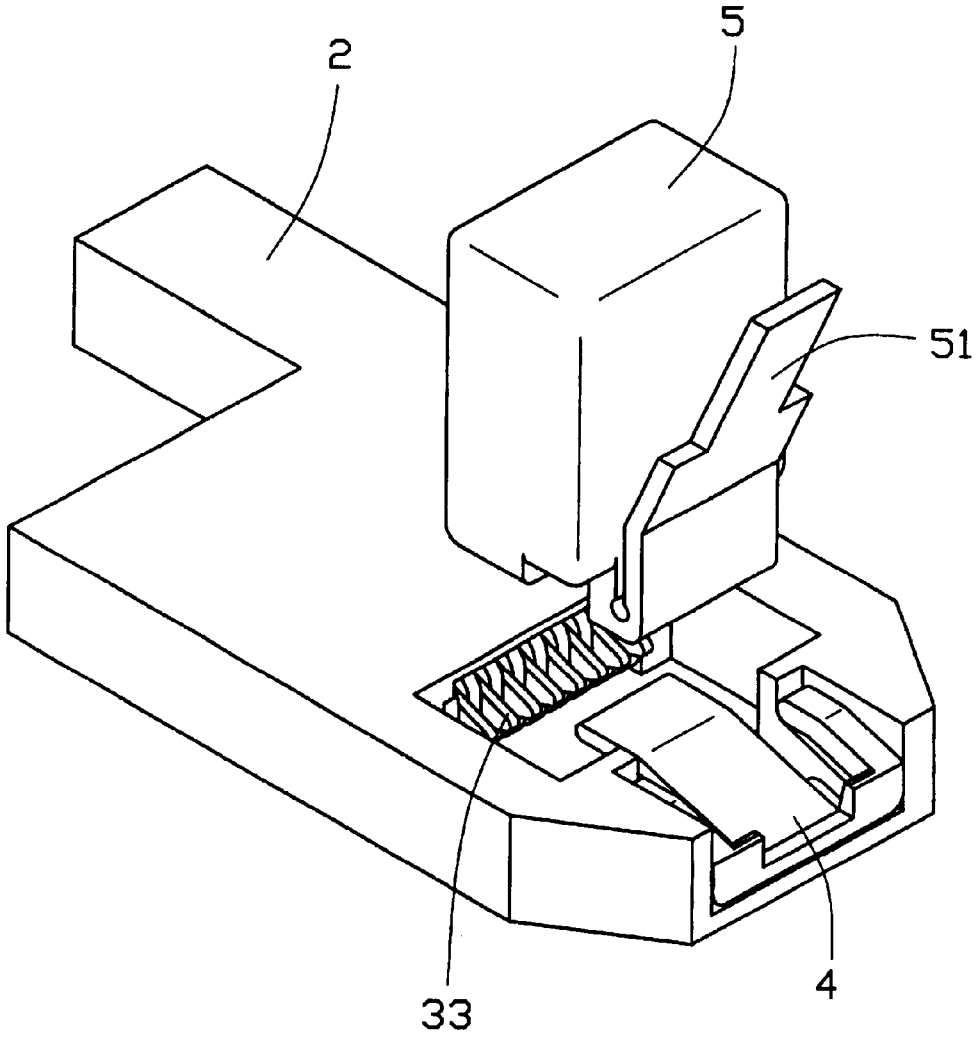
FIG. 5 is a bottom view of FIG. 4 with an RJ plug connector.

Referring to FIG. 1, an electrical connector 1 for contacting either an RJ-11 plug connector or an RJ-45 plug connector (not shown) comprises a slide body 2, a terminal module 3 assembled on the slide body 2, and a lock 4 assembled in the slide body 2 to engage with a latch of the mating RJ plug connector 5 (only shown in FIG. 5).

The slide body 2 includes a planar bottom plate 20 and a pair of sidewalls 21 extending upwardly from transverse edges of the bottom plate 20. A receiving space 200 is defined between the sidewalls 21 and the bottom plate 20 for receiving the terminal module 3 and a mating FPC 6 (only shown in FIG. 4) therein. The sidewalls 21 define three recesses 210 communicating with the receiving space 200.

Figure 2:
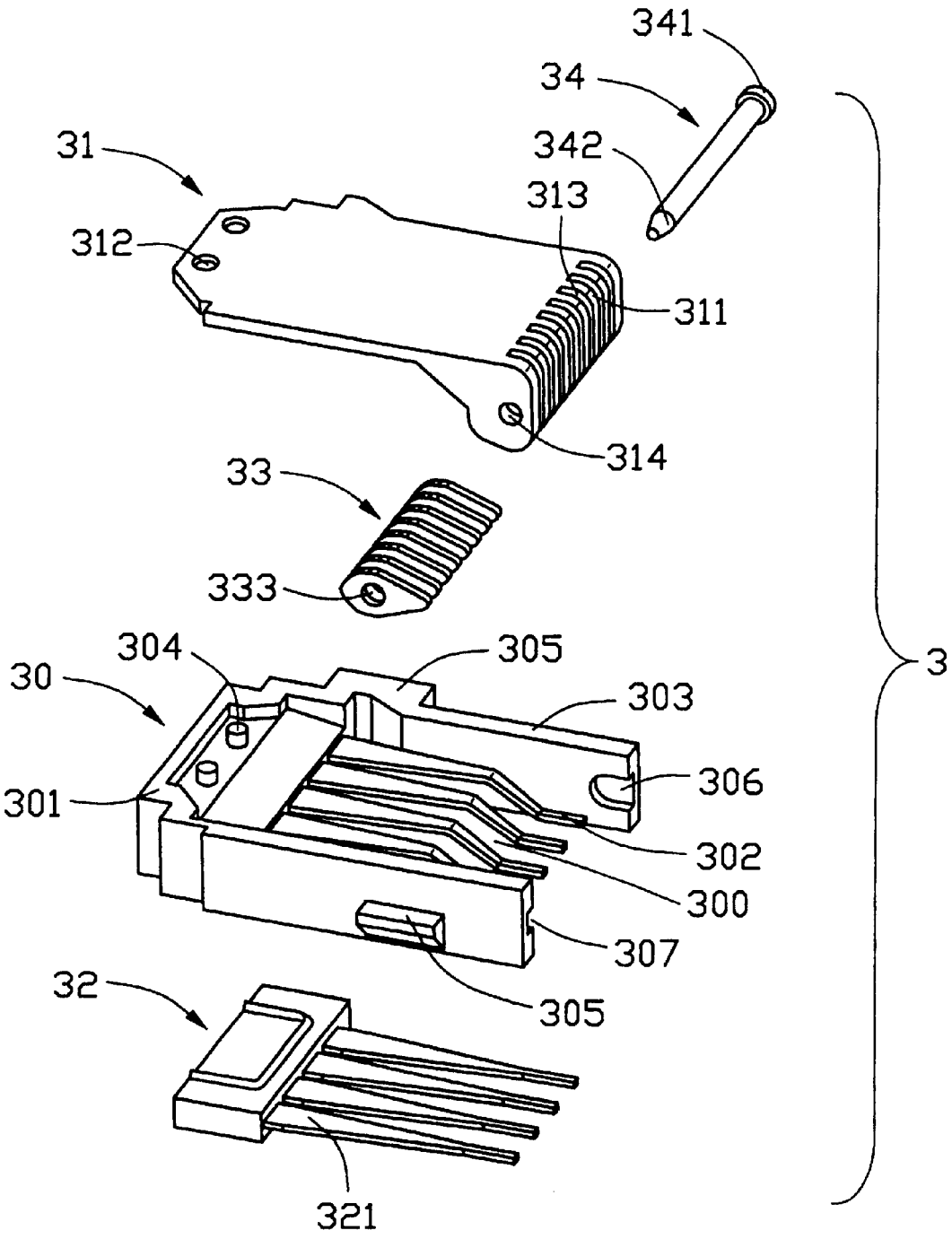
FIG. 2 is an enlarged, perspective and exploded view of a terminal module in FIG. 1.
Figure 3:
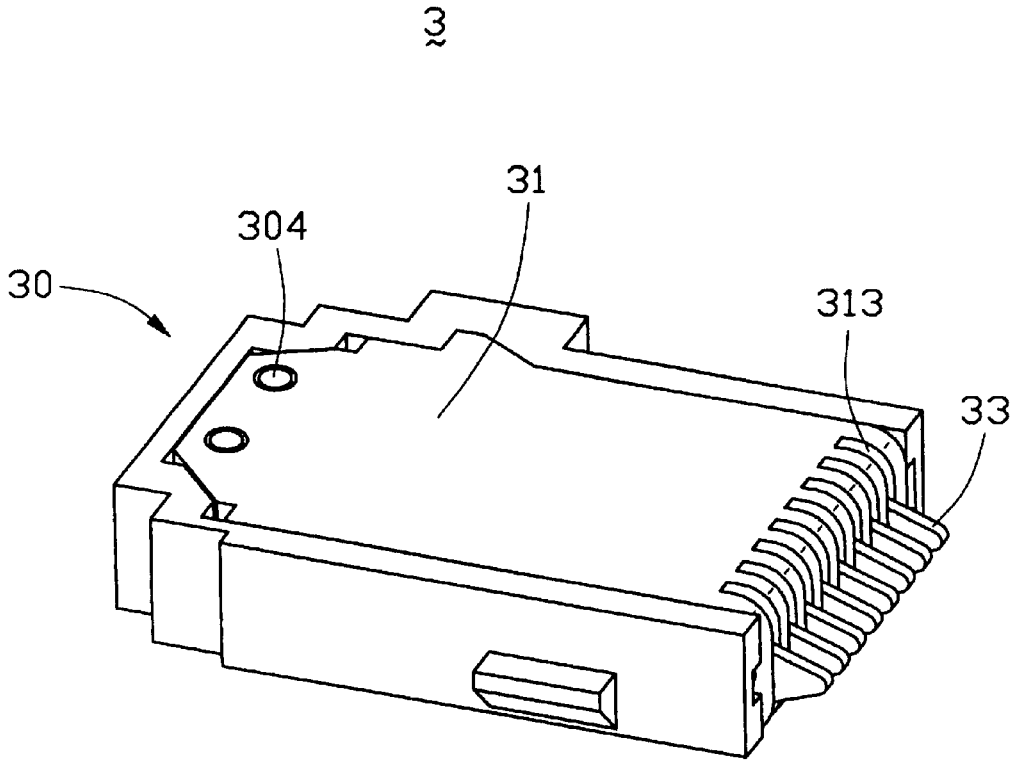
FIG. 3 is an enlarged, assembled view of the terminal module of FIG. 2.

Referring to FIGS. 2 and 3, the terminal module 3 includes a main base 30, a top cover 31 assembled upon the main base 30, a bottom base 32 welded to the main base 30, eight terminals 33 pivotably received in the top cover 31 and a pivot 34 for retaining the terminals 33 in the top cover 31.

The main base 30 comprises a rear base 301, four upper contacts 302 insert molded together with the rear base 301 and a pair of front arms 303 extending forwardly from transverse ends of the rear base 301 together defining an opening 300 for receiving the top cover 31. The rear base 301 comprises a pair of posts 304 extending upwardly. The front arms 303 comprise three projections 305 extending outwardly to be received in the recesses 210 of the slide body 2, thereby securely retaining the terminal module 3 in the receiving space 200. In addition, one front arm 303 defines a big recess 306 at a front end of an inner side thereof, and similarly, the opposite front arm 303 defines an opposite small recess 307.

The top cover 31 comprises a plurality of ribs 311 at a front end thereof and a pair of through holes 312 at a rear end thereof for receiving the posts 304. Every two ribs 311 define a passageway 313 for receiving corresponding terminal 33 and the ribs 311 each define a coaxial transverse hole 314 for receiving the pivot 34.

Each terminal 33 is substantially a cam-shaped plate, and comprises a coaxial hole 333 for receiving the pivot 34.

The pivot 34 comprises a big head 341 at one end thereof and a small tip 342 at an opposite end thereof. The small tip 342 and the big head 341 are respectively received in the small and big recesses 306, 307 of the arms 303.

The bottom base 32 is ultrasonic welded to the main base 30 and comprises four lower contacts 321 insert molded together with the bottom base 32.

Figure 4:
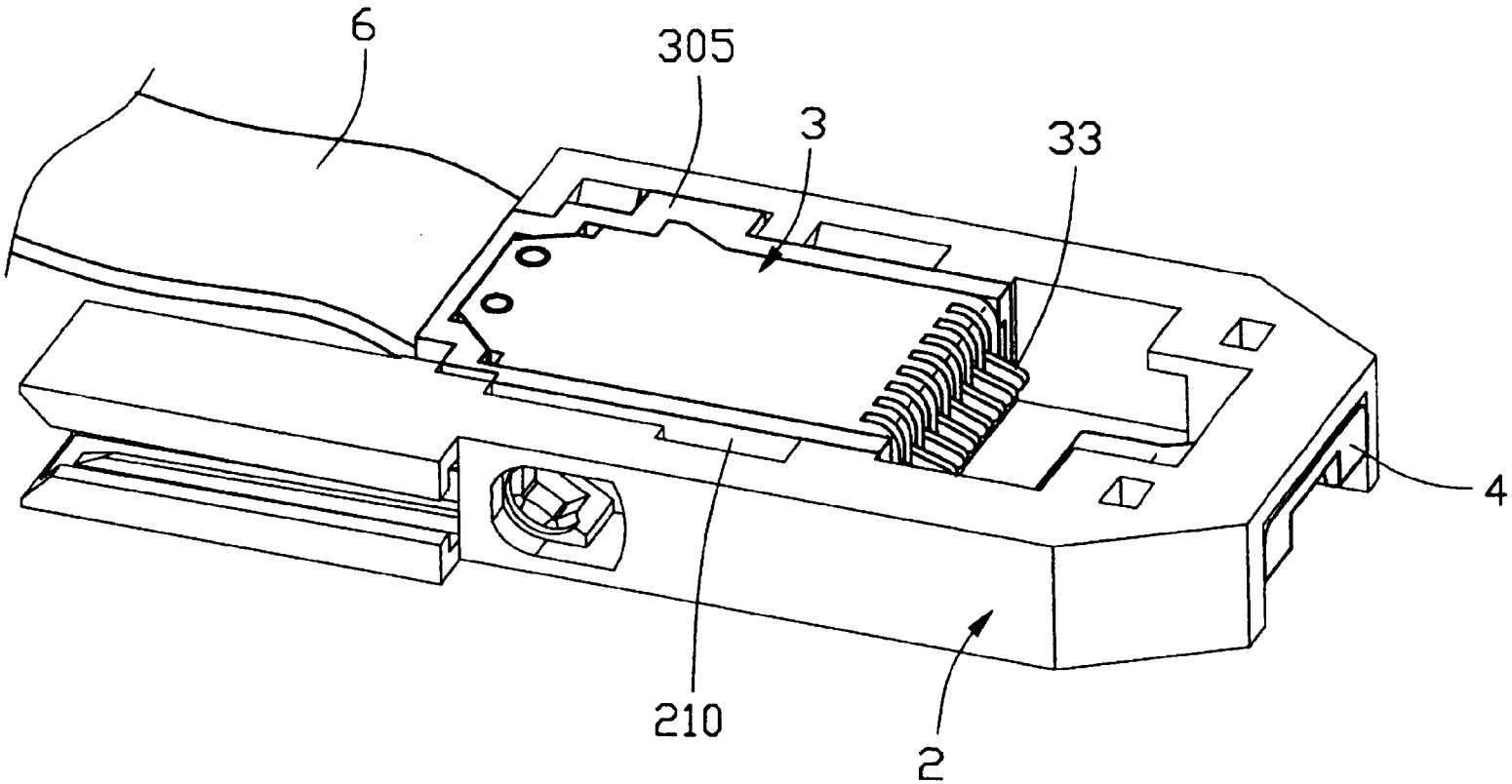
FIG. 4 is an assembled view of the electrical connector of FIG. 1.

Referring to FIG. 4, in manufacturing and assembly, the main base 30 and the bottom base 32 are respectively insert molded with the upper and lower contacts 302, 321. Then, the bottom base 32 is ultrasonic welded to the main base 30 with the upper contacts 302 alternating with the lower contacts 321. The terminals 33 are assembled in corresponding passageways 313 of the top cover 31 with the pivot 34 being inserted into the transverse coaxial holes 312 of the ribs 311 and the terminals 33. Subsequently, the top cover 31 is assembled in the opening 300 of the main base 30 in a front-to-rear direction. The head 341 and the tip 342 of the pivot 34 are respectively received in the big recess 306 and small recess 307 of the main base 30. The posts 304 are received in the through holes 312 of top cover 31. Finally, the main base 30 is placed in the receiving space 200 of the slide body 20 with the three projections 305 being received in corresponding recesses 210 for securely retain the terminal module 3 in the receiving space 200 of the slide body 2.

Referring to FIGS. 4 and 5, in mating, a mating flexible printed circuit (FPC) 6 is inserted into the receiving space 200 from a rear end thereof to electrically contact with the upper and lower contacts 302, 321. Subsequently, the RJ plug connector 5, either an RJ-11 plug connector or an RJ-45 plug connector, is inserted into the receiving space 200 of the slide body 2 to contact with the terminals 33 of the terminal module 3. The lock 4 is rotated about its own pivot to be engaged with a latch 51 of the plug connector 5 to securely retain the plug connector 5 on the electrical connector 1. If an RJ-45 plug connector mates with the electrical connector 1, the eight terminals 33 are all received in corresponding passageways defined by the RJ-45 plug connector to contact corresponding terminals of the RJ-45 plug connector with the upper and lower contacts 302, 321. While an RJ-11 plug connector mates with the electrical connector 1, a few terminals of the eight terminals 33 are received in corresponding passageways defined by the Rj-11 plug connector, and the rest of the terminals 33 are pressed by the RJ-11 plug connector to rotate about the pivot 34 and being protected. Thus, an electrical connection between FPC and the plug connector, either the RJ-11 plug connector or the RJ-45 plug connector, is achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for contacting multiple types of connector plugs, comprising:

a slide body defining a receiving space; and a terminal module received in the receiving space and comprising:

a main base assembled in the receiving space, and comprising an opening in a front end thereof and a plurality of upper contacts extending forwardly into the opening;

a bottom base assembled on the main base and comprising a plurality of lower contacts extending forwardly and alternating with the upper contacts;

a top cover received in the opening of the main base and defining a plurality of ribs at a front end thereof, every two ribs defining a passageway; and a plurality of terminals pivotably received in the passageways for contacting with the upper and lower contacts; wherein each terminal is substantially a cam-shaped, and comprises a coaxial hole for receiving a pivot;

wherein the electrical connector may contact with any one of the multiple types of connector plugs without damaging the terminals and contacts of the electrical connector.

2. The electrical connector described as claim 1, wherein the main base comprises at least two projections, and the slide body defines at least two recesses receiving the at least two projections to retain the terminal module in the receiving space of the slide body.

3. The electrical connector described as claim 1, wherein the main base comprises a pair of pivots and the top cover defines a pair of through holes for receiving the pivots to retain the top cover on the base.

4. The electrical connector described as claim 1, further comprising a lock assembled in the slide body to engage with a latch of the RJ plug connector.

5. The electrical connector described as claim 1, wherein each of the ribs and terminals defines a coaxial transverse hole, and the terminal module comprises a pivot received in the coaxial transverse hole to pivotably retain the terminals in the passageways.

6. The electrical connector described as claim 2, wherein the main base comprises a pair of front arms extending forwardly, and the front arms and each arm define a recess for receiving an end of the pivot.

7. An electrical connector for contacting multiple types of connector plugs, comprising:

a slide body defining a receiving space and at least one recess communicating with the receiving space; and a terminal module received in the receiving space and comprising:

a main base comprising at least one projection extending outwardly for being received in the at least one recess of the slide body;

a plurality of upper contacts assembled on the main base; a bottom base assembled on the main base;

a plurality of lower contacts assembled on the bottom base and alternating with the upper contacts; a top cover assembled on the main base; and a plurality of terminals pivotably assembled on the top cover for contacting with the upper and lower contacts; wherein each terminal is substantially a cam-shaped, and comprises a coaxial hole for receiving a pivot;

wherein the electrical connector may contact with any one of the multiple types of connector plugs without damaging the terminals and contacts of the electrical connector.

8. The electrical connector described as claim 7, wherein the main base comprises a pair of front arms extending forwardly and together defining an opening for receiving the top cover.

9. A process for assembling a terminal module that may contact with any one of multiple types of connector plugs, the terminal module comprising a main base with a plurality of upper contacts, a bottom base with a plurality of lower contacts, a top cover, a plurality of terminals and a pivots, wherein each terminal is substantially a cam-shaped, and comprises a coaxial hole for receiving the pivot, the main base comprising a pair of posts extending upwardly and a pair of front arms extending forwardly together defining an opening, the top cover comprising a pair of through holes at a rear end thereof and a plurality of passageways at a front end thereof, the process comprising:

assembling the bottom base on the main base with the upper contacts alternating with the lower contacts;

pivotably retaining the terminals in corresponding passageways of the top cover by the pivot; and mounting the top cover in the opening of the main base, with the posts of the main base being received in the through holes of the top cover and two ends of the pivot being received in the front arms of the main base.

10. An electrical connector for contacting multiple types of connector plugs, comprising:

a slide body extending in a longitudinal direction and defining a receiving space therein;

a terminal module received within said receiving space, said terminal module comprising:

a main base defining a rear base with a pair of forwardly extending front arms;

a plurality of contacts extending among the rear base and said pair of front arms;

a plurality pivotal terminals positioned around the front distal ends of the contacts and engageable with front distal ends of said contacts; wherein each terminal is substantially a cam-shaped, and comprises a coaxial hole; and a pivot extending through said coaxial hole of said terminals, said pivot being supportably retained by and on said front distal end of said pair of front arms; wherein said terminal module is assembled to said slide body in a vertical direction perpendicular to said longitudinal direction, means for retaining said terminal module in said receiving space;

wherein the electrical connector may contact with any one of the multiple types of connector plugs without damaging the terminals and contacts of the electrical connector.

* * * * *